United States Patent [19]

Caine

[11] Patent Number: 4,643,639

[45] Date of Patent: Feb. 17, 1987

[54] ADJUSTABLE CENTRIFUGAL PUMP

[75] Inventor: Gerard H. Caine, Rockford, Ill.

[73] Assignee: Sundstrand Corporation, Rockford, Ill.

[21] Appl. No.: 685,472

[22] Filed: Dec. 24, 1984

[51] Int. Cl.[4] ..... F04D 29/46

[52] U.S. Cl. ..... 415/148; 415/211

[58] Field of Search ..... 415/148, 150, 157, 158, 415/211, 27, 36, 38, 42, 43, 207, 210; 60/39.23, 751; 417/406–409

[56] References Cited

U.S. PATENT DOCUMENTS

| | | | |
|---|---|---|---|
| 1,382,605 | 6/1921 | Carson | 415/148 X |
| 1,527,760 | 2/1925 | Taylor | 415/157 |
| 2,114,285 | 4/1938 | Berger | 415/211 X |
| 3,365,120 | 1/1968 | Jassniker | 415/26 |
| 3,667,860 | 6/1972 | Endress et al. | 415/150 |
| 3,751,178 | 8/1973 | Paugh et al. | 415/211 X |
| 3,941,498 | 3/1976 | Duckworth et al. | 415/150 X |
| 4,008,010 | 2/1977 | Fauconnet | 415/150 X |
| 4,056,330 | 11/1977 | Lieber | 415/1 |
| 4,094,613 | 6/1978 | Bracken | 415/158 X |
| 4,257,733 | 3/1981 | Bandukwalla et al. | 415/150 X |
| 4,265,592 | 5/1981 | Carlini | 415/157 |

FOREIGN PATENT DOCUMENTS

| | | | |
|---|---|---|---|
| 670067 | 11/1929 | France . | |
| 542221 | 4/1956 | Italy | 415/158 |
| 53-24603 | 7/1978 | Japan . | |
| 54-113613 | 10/1979 | Japan | 415/211 |
| 58-53700 | 3/1983 | Japan | 415/211 |
| 55579 | 6/1943 | Netherlands . | |
| 388220 | 6/1965 | Switzerland . | |
| 339720 | 12/1930 | United Kingdom . | |
| 1445016 | 8/1976 | United Kingdom | 415/148 |
| 2031069 | 4/1980 | United Kingdom . | |

*Primary Examiner*—Robert E. Garrett
*Assistant Examiner*—Joseph M. Pitko
*Attorney, Agent, or Firm*—Wood, Dalton, Phillips, Mason & Rowe

[57] ABSTRACT

An improved pump for efficient operation at low flow rates to avoid undue power consumption and heating of the fluid being pumped. There is provided a centrifugal pump including a housing with an inlet. A radial or mixed flow discharge impeller is rotatably mounted within the housing and an outlet volute extends about the impeller. First and second axially spaced diffusion passages establish fluid communication between the impeller and the volute and a valve is provided for closing one of the passages when low flow rates are demanded of the pump to minimize recirculation, leakage and churning losses consuming the power and leading to heating of the fluid.

9 Claims, 4 Drawing Figures

Fig. 1.
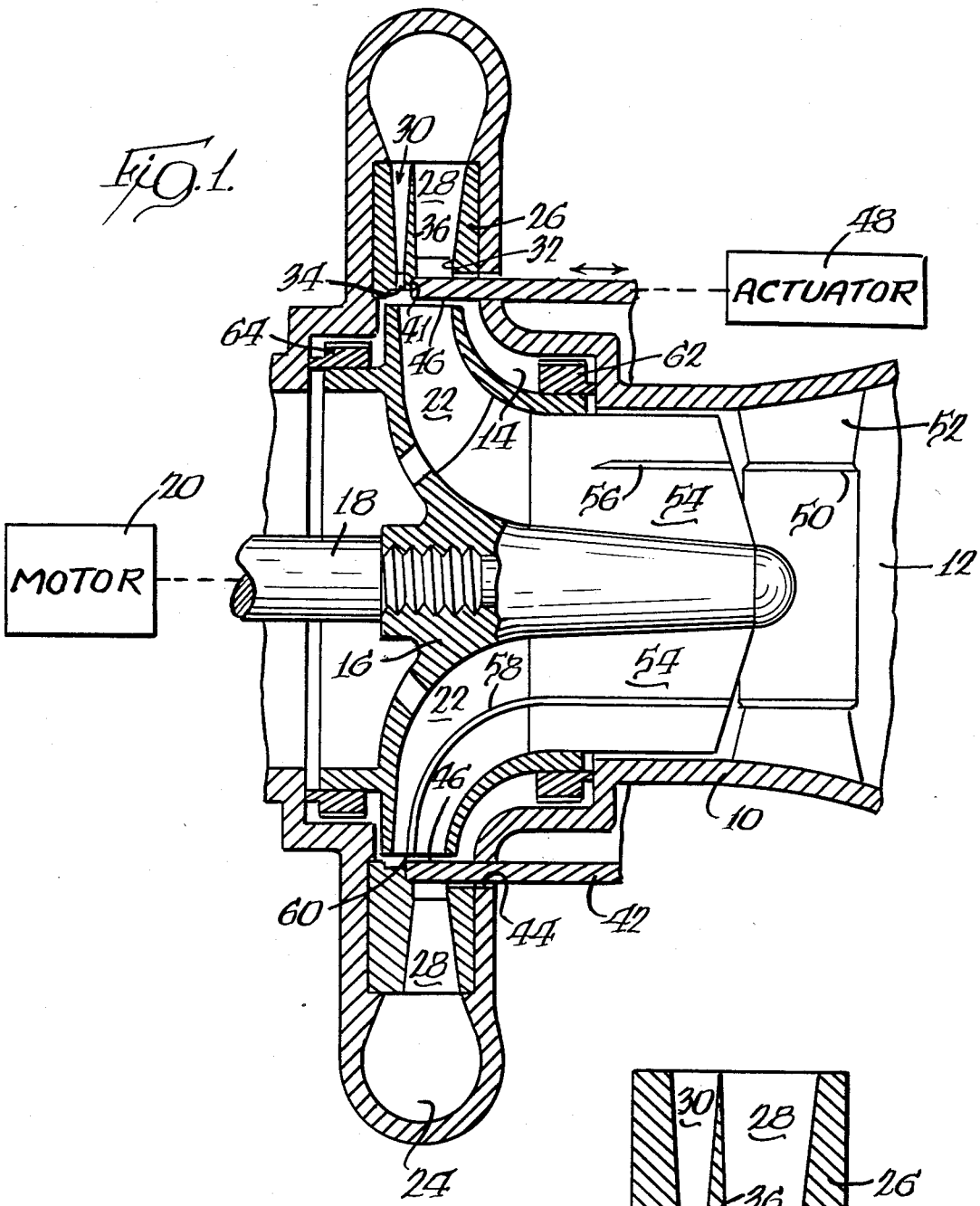
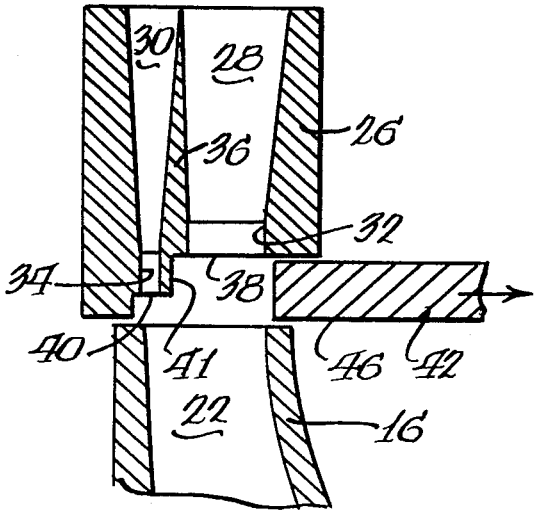
Fig. 2.

ADJUSTABLE CENTRIFUGAL PUMP

FIELD OF THE INVENTION

This invention relates to centrifugal pumps, and more specifically, to a centrifugal pump that is adjustable so as to provide improved efficiency at less than maximum design flow rates. Other objectives are to make such adjustments operable and reliable when the liquids are contaminated by some solids or erosive or corrosive materials.

BACKGROUND OF THE INVENTION

Centrifugal pumps of conventional design operate at very low efficiency when they are required to produce flow rates that are fractions of their maximum or design flow rate. Consequently, when centrifugal pumps are employed in systems requiring variable flow rates and operate in such systems at low flow rates, they waste considerable power.

The wasted power is dissipated, in largest part, as an increase in the temperature in the fluid being pumped; and in some instances, the resulting increase in temperature presents difficulties.

By way of example, one-may consider centrifugal fuel pumps used in aircraft. Comparatively high fuel flow rates are required to develop high power needed for take-offs, climbs to altitude, emergency situations or in the case of military aircraft such as fighters, for sudden bursts of speed or aerobatic flight maneuvers. At the same time, however, when the engines are operated in so-called flight idle descents, ground idle settings or taxiing, the fuel flows typically may be only about 1.5% to 3% of the flow rates required for high power settings. As a consequence, the wasted power may cause the fuel being pumped to overheat. It may then boil, or decompose. Sludges, gum, cokes or vapors in fuel lines, fuel control valves and injection nozzles may result; and each may interfere with fuel flow, engine power control and system reliability.

The problem can be compounded in aircraft where fuel being pumped to the engine is heated by other means. For example: at extremely high aircraft speeds, impact of ambient air on heat exchangers causes excessive drag and local temperatures which are so high that these cannot be used for some cooling requirements. Consequently, while rejection of such heat to the fuel to be burned is desired, it often cannot be practiced to the extent desirable because of excessive heating of the fuel from power wasted in the fuel pumps at low flow rates. Other problems arise also from contaminants in the fluids, such as dust, sand, fibrous particles or corrosive substances, which cause pump parts to plug up, stick, erode or wear excessively and thus cause the pump to become unreliable or inoperative.

The present invention is directed to overcoming one or more of the above problems.

SUMMARY OF THE INVENTION

It is the principal object of the invention to provide a new and improved centrifugal pump. More specifically, it is an object of the invention to provide an adjustable centrifugal pump that will operate more reliably and efficiently when called upon to produce a low flow rate.

Further objectives are the following: (a) when the pump is adjusted for either high or low flow rates, to provide flow passages sufficiently wide so that they do not become partially blocked or plugged by small contamination particles in the fluid, such as dust, sand, small fibers, corrosion particles, from tanks or pipes. i.e. Extremely narrow flow passages must be avoided. (b) To make the adjustment and its mechanism reliable, so that it will not require excessive force to operate, nor distort nor break, nor become stuck from the build up of contamination particles, corrosion products or gums in close clearances or in any working parts. Thus, extremely close clearances or contamination trapping areas must be avoided in the areas most subjected to dirt. (c) To be able to make the pump and adjustment mechanism parts of hard surfaced materials economically, to resist erosions by abrasive contaminants, such as dust or sand, and to lessen erosion by reducing recirculation of such erosives within the pump.

An exemplary embodiment of the invention achieves the foregoing objectives in a centrifugal pump including a housing provided with an inlet. A radial or mixed flow discharge impeller is rotatably mounted within the housing and an outlet volute extends about the impeller and is spaced radially outwardly therefrom. A first set of passages establishes fluid communication between the periphery of the impeller and the volute. A second set of passages, axially spaced from the first passage, also establishes fluid communication between the periphery of the impeller and the volute. Rugged and reliable valve means are interposed between the impeller and one set of passages for selectively opening or closing one set of passages.

When a low flow rate is required, the valve is closed and only one set of passages is employed. As a consequence, power is conserved by avoiding leaking, recirculating and churning losses that would be present if both sets of passages were to remain open when low flow rates are commanded.

According to a preferred embodiment of the invention, the passages have ends adjacent the impeller and are diffusion passages. The valve means close the ends of one set of the passage adjacent the impeller. In a highly preferred embodiment, the valve is an axially movable, simple, cylinder which surrounds the impeller and is in adjacency thereto.

Preferably, the radially inner surface of the cylinder presents an entirely smooth surface to the impeller in adjacency thereto when the cylinder closes the end or ends of the first passage. For erosion resistance the cylinder can be made of hard materials or be hardened on its surface by various well known means.

In a preferred embodiment, there are axially spaced, annular "grooves" associated with each of the first and second passages. A radially extending continuous web separates the sets of passages includes an uninterrupted step at its radially inner end which may be abutted by the cylinder to act as a valve. The cylinder is uninterrupted, continuous and smooth at its closing end.

Where the passages are to act as diffusion passages, they are provided with a progressively increasing cross section radially outwardly of the impeller and there are a plurality of the first passages, each being angularly spaced from the others while being axially aligned. The second passage(s) is angularly located between adjacent ones of the first passages to provide for compactness in construction and alignment with the impeller discharge.

Such high velocity passages, where erosion is most severe, can readily be fabricated, machined or ground if desired, from hard materials to resist erosion and the cross section of the passages made to pass the largest contamination particles expected. For example, for low flow rates, the passage diameters can be made relatively large, but few in number (e.g. one or two).

Other objects and advantages will become apparent from the following specification taken in connection with the accompanying drawings.

DESCRIPTION OF THE DRAWINGS

FIG. 1 is a somewhat fragmentary sectional view illustrating a centrifugal pump made according to the invention;

FIG. 2 is a fragmentary, enlarged sectional view of a portion of the pump;

DESCRIPTION OF THE PREFERRED EMBODIMENT

Figure 3:
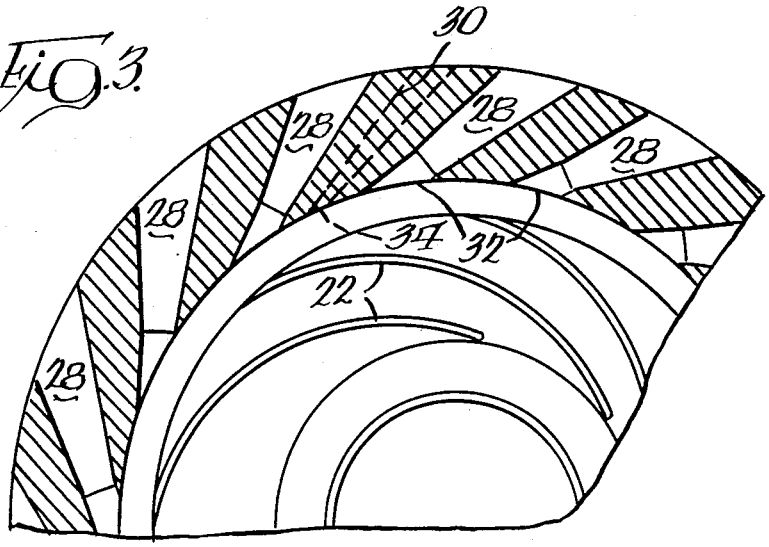
FIG. 3 is a fragmentary sectional view showing the disposition of a first set of diffusion passages employed in the pump.

An exemplary embodiment of a centrifugal pump made according to the invention is illustrated in the drawings and with reference to FIG. 1 is seen to include a housing 10. At one end of the housing 10, the same is provided with an inlet 12. The interior of the housing includes a pumping chamber 14 which is occupied by a radial discharge impeller 16 which may be of conventional construction. However, it is to be understood that the invention may also be employed with efficacy with so-called "mixed" flow discharge impellers, that is, impellers that discharge the fluid both radially and axially. The impeller 16 is mounted on a shaft 18 and suitably journalled for rotation by means not shown. A drive means such as an engine or a motor 20 is operable to rotate the shaft 18, and thus the impeller 16. Upon such rotation, vanes 22 carried by the impeller and of conventional configuration are operable to pump a fluid received at the inlet 12 radially outwardly of the axis of the shaft 18.

An outlet for the pump is provided in the form of a conventional low velocity volute 24 which is located radially outwardly of the impeller 16 and generally aligned with the discharge ends of the vanes 22. Interposed between the volute 24 and the periphery of the impeller 16 is a diffusion structure 26. The diffusion structure 26 includes a first set of diffusion passages 28. As seen in FIG. 1, the passages 28 are axially aligned. As seen in FIG. 3, they are angularly spaced. To operate as diffusion passages, the cross section of the passages 28 increase radially outwardly of the axis of the shaft 18.

Returning to FIG. 1, axially spaced from the diffusion passages 28, the diffusion structure 26 also includes a second set of one or more diffusion passages 30. As can be seen in FIG. 1, the diffusion passage or passages 30 are axially spaced from the set of diffusion passages 28 and are fewer in number. They can also be smaller in size if feasible to pass contaminants.

Diffusion passages 28 and 30 have respective ends 32 and 34 which are adjacent to the periphery of the impeller 16 and by reason of their extension to the volute 24, establish fluid communication between the impeller 16 and the volute 24.

Figure 4:
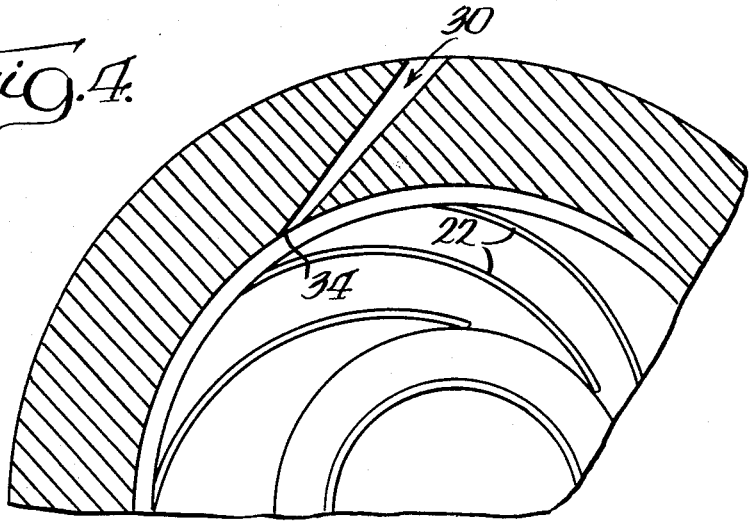
FIG. 4 is a view similar to FIG. 3 but showing the disposition of another set of diffusion passages.

The passages 28 on the one hand and passages or passage 30 on the other hand are separated by a radially extending web 36. And, as can be best seen in FIGS. 3 and 4, in addition to being axially spaced from the diffusion passages 28, the diffusion passages or passage 30 are angularly spaced to fall between adjacent ones of the diffusion passages 28 in the diffusion structure 26. The diffusion passage or passages 30, like the passages 28, have an increasing cross sectional radially outwardly of the shaft 18 and the foregoing arrangement allows the passage or passages 30 to be closely axially spaced to the passages 28 without unduly weakening the web 36 because of the staggered nature of the arrangement.

As seen in the various figures, the diffusion structure 28 includes a first annular space or "groove" 38 in axial alignment with the diffusion passages 28 and opening to the impeller 16. Axially spaced from the groove 38 is a similar annular "groove" 40 of lesser diameter associated with the diffusion passages 30. The groove 40 also opens to the impeller 16 and it will be observed that the grooves 38 and 40, due to their differing diameters, form a continuous, uninterrupted step 41 at the radially innermost part of the web 36.

A hollow cylinder 42 defines a valve and is mounted for axial movement through a suitable opening 44 in the housing 10. The outer diameter of the cylinder 42 is less than the diameter of the groove 38 while the inner diameter of the cylinder valve 42 is greater than the diameter of the impeller 16. Additionally, it should be noted that the radially inner surface 46 of the cylinder 42 and its continuous sealing end are is made quite smooth and can readily be hardened or ground to diameter if required.

An actuator 48 of any suitable form may be used to shift the cylinder 42 axially to a position such as shown in FIG. 1 wherein it abuts and seals against the continuous step 41; or to a position such as shown in FIG. 2 whereat it is remote from step 41. In the position shown in FIG. 1, the cylinder 42 closes or blocks and seals the ends 32 of the diffusion passages 28. When the actuator 48 is operated to move the cylinder 42 to the position shown in FIG. 2, the ends 32 of the diffusion passages 28 are open. Thus, for the former condition, fluid communication from the impeller 16 to the volute 24 is blocked while for the latter condition, fluid communication between the impeller 16 and the volute 24 is established.

Desirably, the inlet 12 and/or the impeller 16 may be provided with flow path splitting baffles. As seen in FIG. 1, a cylindrically-shaped baffle 50 is supported by webs 52 extending radially inwardly from the housing 10. Vanes 54 in the impeller may support an aligned, cylindrical baffle 56 if desired. Moreover, as shown in the lower part of FIG. 1, the baffle 56 may be extended as at 58 all the way to the periphery of the impeller 16 to terminate in an end 60 at least nominally aligned with the radially inner end of the web 36. These can additionally reduce internal liquid recirculations, power losses and temperature rises at low flows.

The housing 10 may also contain labyrinth rings which have small clearances between them and the rotating impeller 16 at its inlet side 62; also opposite the inlet at 64 for hydraulic thrust balancing if required. These may be floating labyrinth rings which have extremely close radial clearances for additionally reducing internal fluid leakage losses and temperature rise of pumped fluid. Further advantages of such rings are that they can be made or surface treated with extremely hard materials to resist erosions by contaminants; also that they can readily be replaced.

In operation, when high flow rates are called for, the cylinder 42 is moved to the position illustrated in FIG. 2. Consequently, both sets of passages 28 and 30 are open to the impeller 16 and to the volute 24 to deliver the maximum flow. Conversely, when low flow rates are required, the cylinder 42 is moved to the position illustrated in FIG. 1 thereby closing off the larger diffusion passages 28 while leaving the smaller diffusion passages 30 open. When the cylinder 42 is in the low flow rate position illustrated in FIG. 1, the smooth interior surface 46 is presented to the impeller 16, and churning losses will be minimized. Furthermore, because the smooth end of the cylinder 42, when in the closed position illustrated in FIG. 1, abuts and seals on the step 41, leakage and/or recirculation losses are minimized. In particular, it will be appreciated that during operation of the pump, the fluid being pumped will be at a relatively high velocity at the inner end 34 of the diffusion passages 30. Thus, a relatively low pressure condition will exist at that point. Conversely, because of the increasing size of the diffusion passages 30, velocity at the volute 24 will be much slower but the pressure will be greater.

Were it not for the ability of the valve 42 to seat and seal over its entire end against the step 41, leakage paths across the step 41 otherwise would exist from a lower pressure higher velocity area (adjacent to the impeller) to high pressure lower velocity area (the interior of the volute 24). Consequently, fluid pumped through the diffusion passages 30 to the volute 24 would then leak under the influence of this pressure differential, back through the diffusion passages 28 to the pumping chamber 14 where it would again be repumped. Such repumping consumes extra power without useful benefit and would lead to further temperature rise in the fluid being pumped.

Consequently, the described construction and operation of the pump of this invention avoids undue heating of the fluid being pumped, due to the reduction of the type of losses mentioned previously allowing the pump to consume less power when operating at low flow rates, thereby to provide improved efficiency of operation.

Further objectives achieved by this pump also include the following: A pump with adjusting mechanism, which does *not* contain delicate parts nor those extremely critical to severe conditions imposed by operations, but which are by size and proportions mechanically strong in order to withstand and operate properly under imposed conditions of high speed operation and high pressure rises; severe externally imposed vibrations or shocks, temperature extremes; quick changes in speed and pressure use; or the water hammer effects caused by demanded sudden changes in flow rates and sudden operations of control valves or its own, self contained flow adjusting mechanism cylinder 42.

This pump does *not* require being stopped in rotation, nor valved off externally, disconnected, nor disassembled and reassembled to change its operational characteristic from a high to low flow range; but this can be accomplished even with a fraction of a second if so required, while the pump is in continuous operation, even at high volumes of rotational speeds, pressure rise and flow rates.

There are no adjustments made to the rotating assembly comprising the impeller, shaft, bearings, seals or drive means. Therefore the pump and adjusting mechanism is suitable for very high speed operation (e.g. 10,000 to 50,000 rpm or more). Such high speeds are frequently required to obtain pressures (several hundred to several thousand psi) and for the resulting good efficiency at comparatively low flow rates with single stage, compact and lightweight pump.

This pump, with its adjusting mechanism does not contain a large number of parts, nor those difficult to align or assemble, nor those of high complexity, nor shapes extremely difficult to produce economically. Thus, it can be designed for reasonably low costs to produce the parts, assemble, maintain, repair, recondition or replace. The cylinder which acts as a valve, and the diffuser ring outside it, have relatively simple shapes to produce, even out of corrosion resistant materials, or hard materials resistant to erosion by abrasive contaminants in the fluid. These are shown made as separable parts, so as to be accessible for easy casting, or machining or, where required for extremely hard materials resistant to erosion for grinding to finished dimensions. The diffusers can be made of separable parts, and can also easily be replaced with differing size or number of openings for differing ratios of low to high flow ranges for differing application requirements, while still using other parts.

Because of the foregoing accessibility of the most critical parts and dimensions for manufacture, (casting or machining or grinding, inspection, assembly, etc.) the dimensions on such parts can be held to what accuracy is required so that performance can be made predictable and reliable without further adjustments; not only in a given pump, but also in others designed to be interchangeable, identical, or similar in performance.

The same principals, which reduce either high or low flow range fluid impacts, churning of recirculation losses, also act to reduce contamination plugging or erosions by the fluid or hard contamination particle impact or scouring. These are (1) surfaces which can be made roughly parallel to the particular high velocity flows (*not* at high incident angles) (2) elimination of non-through—flowing "dead" pockets of annular passages which trap contamination inside the pump, instead of expel it.

Reducing or eliminating the various leakage, churning and other recirculation flow rates or velocities. Such flows also carry with them contaminants which otherwise also churn and recirculate producing increased erosions.

I claim:

1. A centrifugal pump comprising:

a housing;

an inlet for said housing;

a radial or mixed flow discharge impeller rotatably mounted within said housing;

an outlet volute extending about said impeller and spaced radially outwardly therefrom;

at least one first passage establishing fluid communication between the periphery of said impeller and said volute;

at least one second passage axially spaced from said first passage and establishing fluid communication between the periphery of said impeller and said volute;

valve means for selectively opening or closing one of said passages;

said valve means comprising an axially movable uinterrupted smooth cylindrical valve surrounding the periphery of said impeller in adjacency thereto and shiftable axially to open or block and seal the end of said one passage opening to said impeller; and a radially extending web disposed between said passages just radially outwardly of the periphery of said impeller, the radially innermost portion of said web including a radial step which is continuous over its circumference, an end of said cylinder valve being in abutting relation and sealing on said step when said cylinder valve blocks and seals the end of said one passage.

2. The centrifugal pump of claim 1 wherein said passages are diffusion passages and have progressively increasing cross sections radially outwardly of said impeller.

3. A centrifugal pump comprising:

a housing;

an inlet for said housing;

a radial or mixed flow discharge impeller rotatably mounted within said housing;

an outlet volute extending about said impeller and spaced radially outwardly therefrom;

at least one first passage establishing fluid communication between the periphery of said impeller and said volute;

at least one second passage axially spaced from said first passage and establishing fluid communication between the periphery of said impeller and said volute; and valve means for selectively opening or closing one of said passages;

said passages being diffusion passages and having progressively increasing cross sections radially outwardly of said impeller;

said first passages being a plurality of said first passages, each being angularly spaced from the others while being axially aligned, said second passage(s) being angularly located between adjacent ones of said first passages.

4. The centrifugal pump of claim 3 wherein said first passages are larger or more in number, or both than said second passage(s) and said valve means is operative to selectively open or close and completely seal said first passages.

5. A centrifugal pump comprising:

a housing;

an inlet for said housing;

a radial or mixed flow discharge impeller rotatably mounted within said housing;

an outlet volute extending about said impeller and spaced radially outwardly therefrom;

a first set of relatively large diffusion passages establishing fluid communication between the periphery of said impeller and said volute;

at least one second diffusion passage axially spaced from said first passages and establishing fluid communication between the periphery of said impeller and said volute;

an axially movable cylindrical valve for selectively opening or closing said first passages at a location in adjacency to said impeller; and an annular collection groove at the radially inner end of both said first passages and said second passage(s), said grooves being axially spaced; said cylindrical valve being movable into and out of the groove associated with said first passages.

6. The centrifugal pump of claim 5 wherein an annular step is disposed between said grooves and said sleeve valve is movable into abutment with said step to close said first passages.

7. A centrifugal pump comprising:

a housing;

an inlet for said housing;

a radial or mixed flow discharge impeller rotatably mounted within said housing;

an outlet volute extending about said impeller and spaced radially outwardly therefrom;

at least one first relatively large diffusion passage establishing fluid communication between the periphery of said impeller and said volute and having an end adjacent said impeller;

at least one second relatively small diffusion passage axially spaced from said first passage and establishing fluid communication between the periphery of said impeller and said volute; and valve means between said impeller and said first passage(s) for selectively opening or closing said end(s) of said first passage(s).

8. The centrifugal pump of claim 7 wherein said valve means includes an axially movable cylindrical valve.

9. The centrifugal pump of claim 8 wherein the radially inner surface of said cylindrical valve presents an entirely smooth surface to said impeller in close adjacency thereto when said cylindrical valve closes said end(s).

* * * * *